US005383535A

United States Patent [19]

Ando

[11] Patent Number: 5,383,535

[45] Date of Patent: Jan. 24, 1995

[54] SIGNAL TRANSMITTING APPARATUS OF ELEVATOR

[75] Inventor: Hiroshi Ando, Inazawa, Japan

[73] Assignee: Mitsubishi Deni Kabushiki Kaisha, Tokyo, Japan

[21] Appl. No.: 171,974

[22] Filed: Dec. 23, 1993

Related U.S. Application Data

[63] Continuation of Ser. No. 886,232, May 21, 1992, abandoned.

[30] Foreign Application Priority Data

May 22, 1991 [JP] Japan ..... 3-116418

[51] Int. Cl.[6] ..... B66B 1/00

[52] U.S. Cl. ..... 187/247; 187/380; 187/391

[58] Field of Search ..... 187/121, 122, 130, 134, 187/101, 100

[56] References Cited

U.S. PATENT DOCUMENTS

| | | | |
|---|---|---|---|
| 3,782,504 | 1/1974 | Billmaier et al. | 187/121 |
| 4,622,551 | 11/1986 | Kupersmith et al. | 340/825.06 |
| 4,683,989 | 8/1987 | Pillage et al. | 187/121 |
| 5,092,431 | 3/1992 | Schroder | 187/127 |
| 5,142,623 | 8/1992 | Staab et al. | 395/200 |

FOREIGN PATENT DOCUMENTS

| | | |
|---|---|---|
| 61-194943 | 8/1986 | Japan . |
| 63-49942 | 6/1988 | Japan . |
| 1226685 | 11/1989 | Japan . |

*Primary Examiner*—Steven L. Stephan
*Assistant Examiner*—Robert Nappi
*Attorney, Agent, or Firm*—Leydig, Voit & Mayer

[57] ABSTRACT

An elevator signal transmitting apparatus of the invention has a parent station provided in a machine room so as to control signal transmission, a plurality of child stations respectively provided in halls so as to control signal transmission, first and second balanced transmission lines each having one end connected to the parent station, first and second unbalanced transmission lines each having one end connected to the plurality of child stations, a first interface unit connected to the other ends of the first balanced transmission line and of the first unbalanced transmission line so as to convert the balanced signal input from the parent station through the first balanced transmission line into an unbalanced signal and output the unbalanced signal to the plurality of child stations through the first unbalanced transmission line, and a second interface unit connected to the other ends of the second balanced transmission line and of the second unbalanced transmission line so as to convert the unbalanced signals input from the plurality of child stations through the second unbalanced transmission line into balanced signals and output the balanced signals to the parent station through the second balanced transmission line.

10 Claims, 5 Drawing Sheets

SIGNAL TRANSMITTING APPARATUS OF ELEVATOR

This application is a continuation of application Ser. No. 07/886,232, filed May 21, 1992 now abandoned.

BACKGROUND OF THE INVENTION

1. Field of the Invention

The present invention relates to improvement in a signal transmitting apparatus of an elevator.

2. Description of the Related Art

The configuration of a conventional signal transmitting apparatus of an elevator is described below with reference to FIG. 4. FIG. 4 is a block diagram of a conventional signal transmitting apparatus of an elevator disclosed in, for example, Japanese Patent Laid-Open No. 1-226685.

In FIG. 4, on a control panel 1 in a machine room are provided a main microcomputer 2 for controlling the movement of an elevator, a hall transmission control microcomputer 3 for controlling serial transmission on the side of halls and a car transmission control microcomputer 4 for controlling serial transmission on the side of a car.

Hell microcomputers 6, 7, 8 and 9 are connected to the hall transmission control microcomputer 3 through a signal line 5. On the Other hand, a car indicator control microcomputer 12 and a car operating panel control microcomputer 13, both of which are provided in a car 11, are connected to the car transmission control microcomputer 4 through a signal line 10. Although the signal lines alone are shown as transmission lines, a power source line, a GND line and the like are also present.

The signal transmission in the above-described conventional apparatus is in an unbalanced half-duplex transmission system. This half-duplex transmission system has problems in that only to a small amount of data is transmitted at a low processing speed because data is transmitted and received through a single signal line. Accordingly, to avoid the preceding problem unbalanced full-duplex transmission systems have been employed.

Another conventional apparatus which uses an unbalanced full-duplex transmission system is described below with reference to FIG. 5.

In FIG. 5, the transmitting section $T_x$ of a hall transmission control microcomputer 3 is connected to the receiving section Rx of each of hall microcomputers 6 to 9 through a signal line 14, and the receiving section Rx of the hall transmission control microcomputer 3 is connected to the transmitting section Tx of each of the hall microcomputers 6 to 9 through a signal line 15. The transmitting section Tx of a car transmission control microcomputer 4 is connected to the receiving section Rx of each of car microcomputers 12 and 13 through a signal line 16, end the receiving section Rx of the car transmission control microcomputer 4 is connected to the transmitting section Tx of each of the car microcomputers 12 and 13 through a signal line 17. Although the signal lines alone are shown as transmission lines, a power source line, a GND line and the like are also laid.

The hall microcomputers 6 to 9 and the car microcomputers 12 and 13 successively transmit data by polling from the hall transmission control microcomputer 3 and the car transmission control microcomputer 4, respectively. However, the number of hall microcomputers to be polled is increased as the number of the hall microcomputers installed is increased, and transmission thus requires a long time. The procedure of transmission is established so that data can be simultaneously transmitted from each of the hall microcomputers 6 to 9 and each of the car microcomputers 12 and 13 to the hall transmission control microcomputer 3 and the car transmission control microcomputer 4, respectively. In addition, a driver of the transmitting section Tx of each of the hall microcomputers 6 to 9 and the car microcomputers 12 and 13 comprises an Open collector type transistor having a hardware (H/W) which allows data collision.

An unbalanced signal transmission line has low noise resistance and is thus difficult to use for long-distance transmission. For example, in the signal transmitting apparatus of an elevator shown in FIG. 5, when a transmission distance is several hundreds m or more, the noise resistance deteriorates, and transmission error is detected.

The case where balanced signal transmission lines are used for increasing the transmission distance is described below with reference to FIG. 6. FIG. 6 shows only the transmission lines through which a hall microcomputer 6 (transmission side) transmits data no a hall transmission control microcomputer 3 (receiving side). A driver 18 on the transmission side 6 is connected to a receiver 22 comprising a differential amplifier on the receiving side 3 through a balanced transmission line 19 comprising signal lines 20 and 21.

For instance, when a high-level signal is output from the transmission side 6, the signal line 20 is a high level, and the signal line 21 is a low level so that the receiving side 3 receives a high-level signal. When a low-level signal is output from the transmission side 6, the signal line 20 is in a low level, and the signal line 21 is in a high level so that the receiving side 3 receives a low-level signal. Namely, Since the receiving side 3 receives data on the basis of a difference between two signal levels, the noise resistance is excellent. Although FIG. 6 shows only the transmission line from the hall microcomputer 6 to the hall transmission control microcomputer 3, the same transmission line is provided for transmission from the hall transmission control microcomputer 3 to the hall microcomputer 6.

A description is now be made of the case where the balanced transmission line shown in FIG. 6 is applied to the elevator signal transmitting apparatus shown in FIG. 5. If the output from all the hall microcomputers 6 to 9 is connected to the signal lines 20, 21 by wired OR, for example, when the hall microcomputer 6 outputs a high-level signal, and when the hall microcomputer 7 outputs a low-level signal, the driver 18 of the hall microcomputer 6 drives the signal line 20 in a high level and the signal line 21 in a low level, and the driver 18 of the hall microcomputer 7 drives the signal line 20 in a low level and the signal line 21 in a high level. As a result, both signals collide with each other, and the output of the receiver 22 becomes unstable. Namely, collision of data is not allowed.

Thus the balanced transmission lines must be laid in one-to-one correspondence between the hall transmission control microcomputer 3 and the hall microcomputers 6 to 9. This increases the number of signal lines required and thus causes an increase in the cost and deterioration in the workability.

The above-described conventional elevator signal transmitting apparatuses have the problem that long-distance transmission cannot be easily achieved by unbalanced transmission lines alone from the viewpoint of noise resistance.

The conventional apparatuses also have the problem that since wired OR connection cannot be made by balanced transmission lines alone, the number of signal lines increases, the interface cost increases, and the transmission efficiency deteriorates.

SUMMARY OF THE INVENTION

The present invention has been designed for solving the above problems, and it is an object of the invention to provide an elevator signal transmitting apparatus which can be applied to long-distance signal transmission, which can minimize an increase in the number of signal lines and which allows data collision.

An elevator signal transmitting apparatus of the present invention comprises a parent station provided in a machine room so as to control signal transmission, a plurality of child stations respectively provided in halls so as to control signal transmission, first and second balanced transmission lines each having one end connected to the parent station, first and second unbalanced transmission lines each having one end connected to the plurality of child stations, first interface means connected to the other ends of the first balanced transmission line and of the first unbalanced transmission line so as to convert the balanced signal input from the parent station through the first balanced transmission line into an unbalanced signal and output the unbalanced signal to the plurality of child stations through the first unbalanced transmission line, and second interface means connected to the other ends of the second balanced transmission line and of the second unbalanced transmission line so as to convert the unbalanced signal input from each of the plurality of child stations through the second unbalanced transmission line into a balanced signal and output the balanced signal to the parent station through the second balanced transmission line.

DESCRIPTION OF THE PREFERRED EMBODIMENTS

Figure 1:
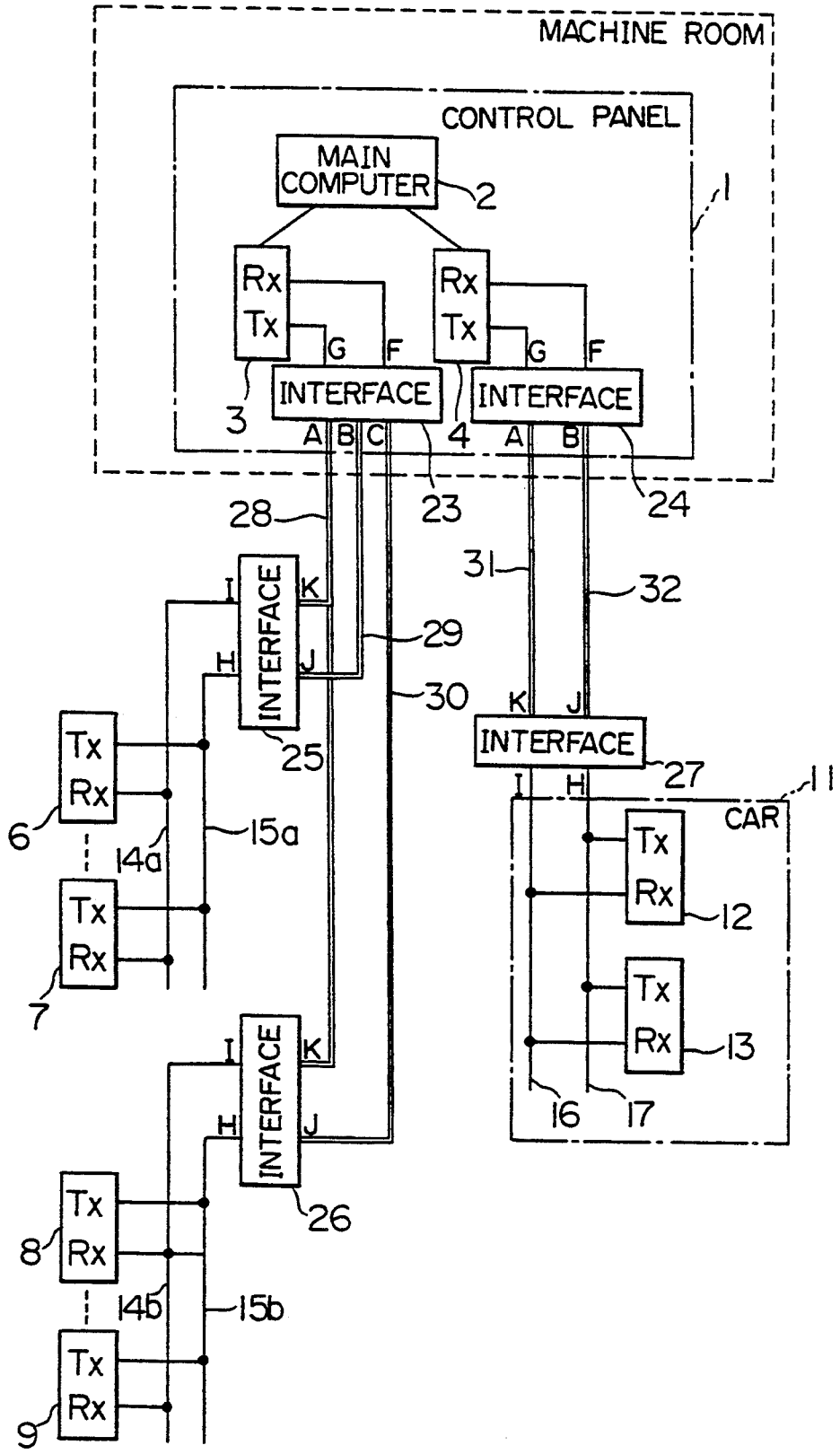
FIG. 1 is a block diagram showing an elevator signal transmitting apparatus in accordance with an embodiment of the present invention.

FIG. 1 is a block diagram showing an embodiment of the present invention. In FIG. 1, a control panel 1, a main computer 2, a hall transmission control microcomputer 3, a car transmission control microcomputer 4, hall microcomputers 6 to 9, a car room 11, a car microcomputer 12 and a car operating panel control microcomputer 13 are completely the same as those of the above-described conventional apparatuses.

In FIG. 1, the transmitting section Tx of the hall transmission control microcomputer 3 is connected to the port G of an interface 23, and the receiving section Rx of the hall transmission control microcomputer 3 is connected to the port F of the interface 23. The transmitting section Tx of the car transmission control microcomputer 4 is connected to the port G of an interface 24, and the receiving section Rx of the car transmission control microcomputer 4 is connected to the port F of the interface 24, The port A of the interface 23 is connected to the port K of an interface 23 through a signal line 28 which is a balanced transmission line, and the port B thereof is connected to the port J of the interface 25 through a signal line 29 which is a balanced transmission line. The port A of the interface 23 is also connected to the port K of an interface 26 through the signal line 28, and the port C thereof is connected to the port J of the interface 26 through a signal line 30 which is a balanced transmission line.

On the other hand, the port A of the interface 24 is connected to the port K of an interface 27 through a signal line 31 which is a balanced transmission line, and the port B thereof is connected to the port J of the interface 27 through a signal line 32 which is a balanced transmission line.

Further, the port I of the interface 25 is connected to the receiving section Rx of each of the hall microcomputers 6, 7 through a signal line **14*a* which is an unbalanced transmission line, and the port H thereof is connected to the transmitting section Tx of each of the hall microcomputers 6, 7 through a signal line 15*a* which is an unbalanced transmission line. Similarly, the pork I of the interface 26 is connected to the receiving section Rx of each of the hall microcomputers 8, 9 through a signal line 14*b* which is an unbalanced transmission line, and the port H thereof is connected to the transmitting section Tx of each of the hall microcomputers 8, 9 through a signal line 15*b*** which is an unbalanced transmission line.

The port I of the interface 27 is connected to the receiving section Rx of each of the car microcomputers 12, 13 through a signal line 16 which is an unbalanced transmission line, and the port H thereof is connected to the transmitting section Tx of each of the hall microcomputers 12, 13 through a signal line 17 which as an unbalanced transmission line.

Figure 2:
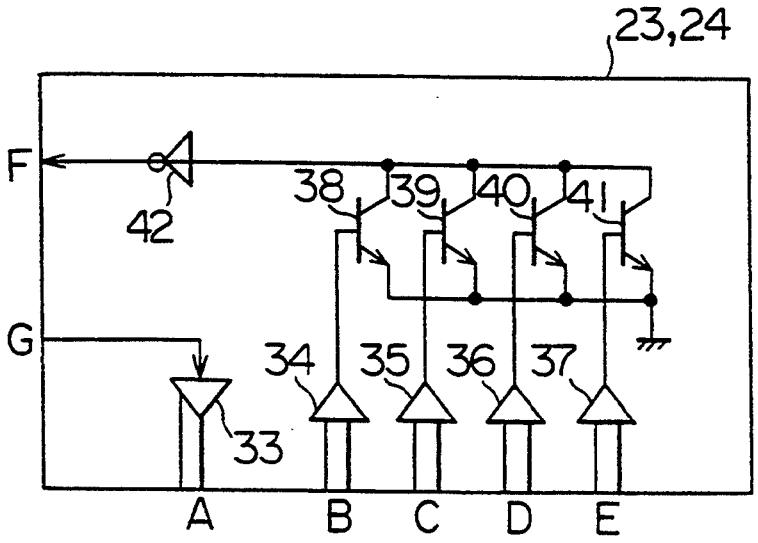
FIGS. 2 and 3 are drawings of circuits respectively showing the internal configurations of the interfaces shown in FIG. 1.
Figure 3:
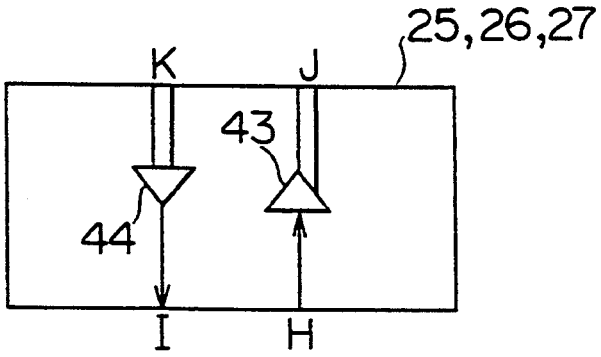
Figure 4:
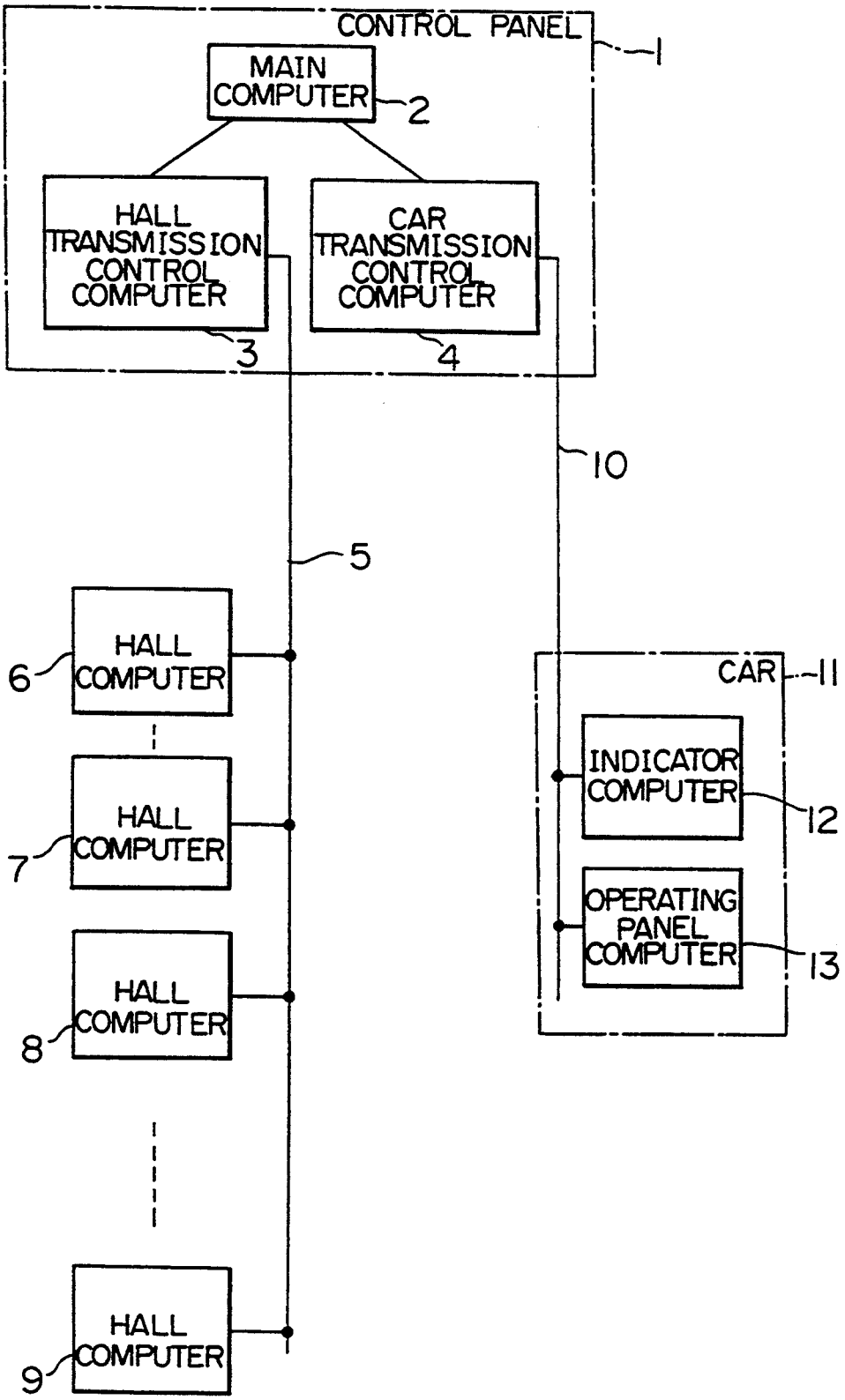
FIG. 4 PRIOR ART
FIG. 4 is a block diagram showing a conventional signal transmitting apparatus.
Figure 5:
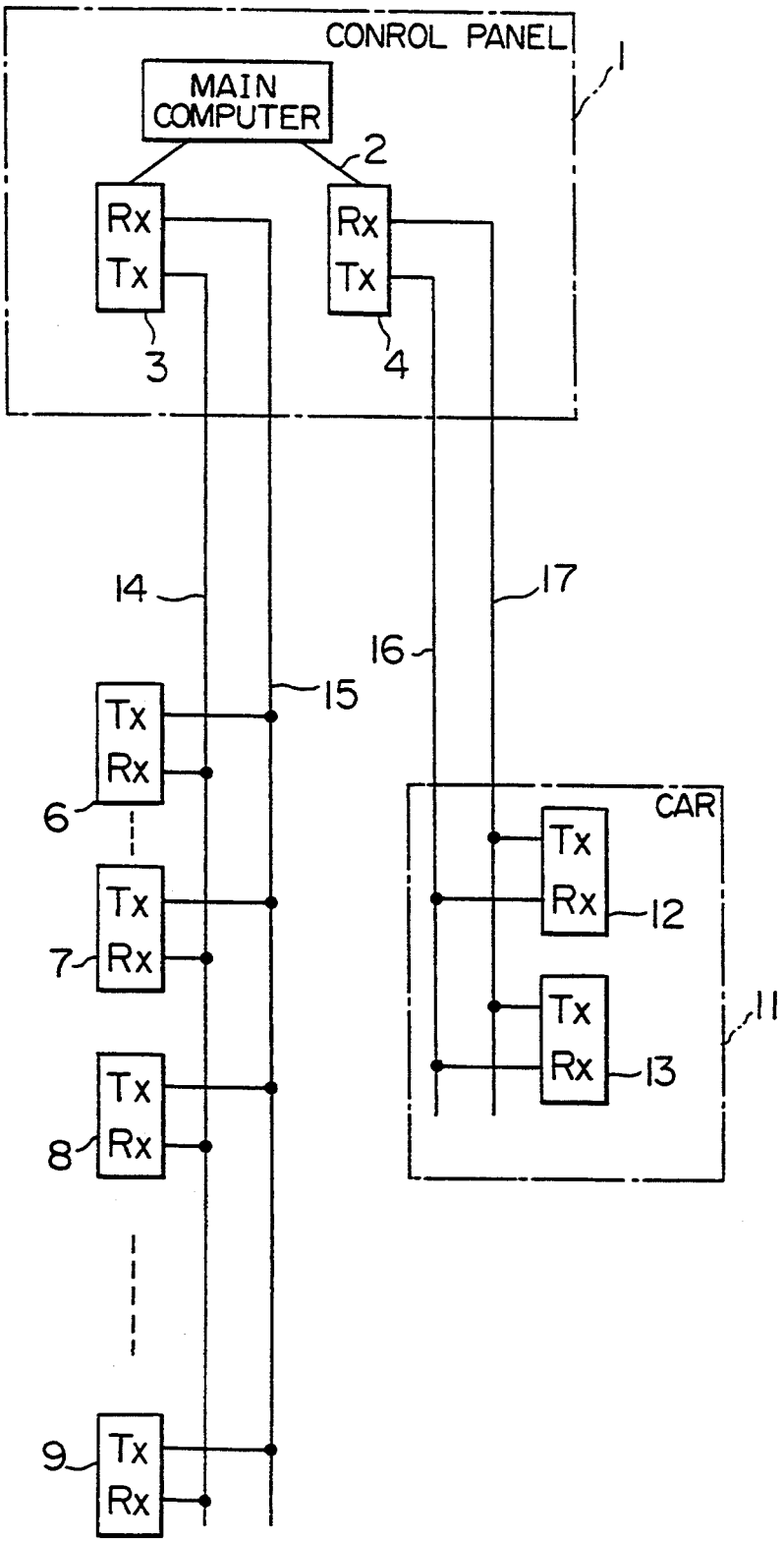
FIG. 5 PRIOR ART
FIG. 5 is a block diagram showing another conventional signal transmitting apparatus.
Figure 6:
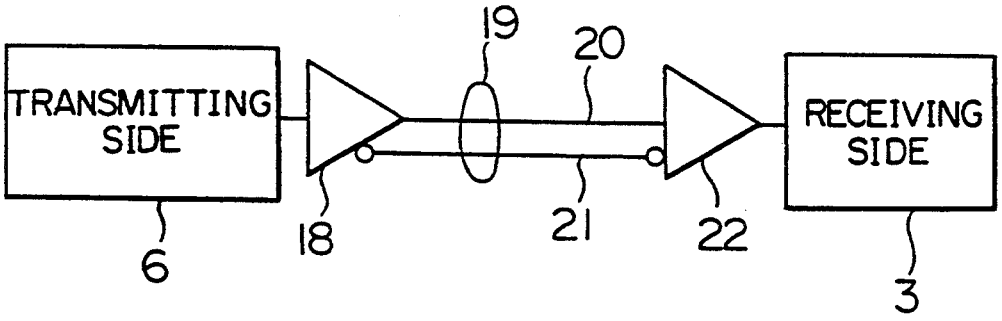
FIG. 6 PRIOR ART
FIG. 6 is a drawing showing a conventional balanced transmission system.

FIG. 2 is a drawing of a circuit showing the interface 23 and 24, and FIG. 3 is a drawing of a circuit showing the interface 25, 26 and 27.

In FIG. 2, a driver 33 converts the unbalanced signal input from the pork G into a balanced signal and outputs the balanced Signal to the port A. Differential amplifiers 34, 35, 36 and 37 convert the balanced signals input from the ports B, C, D and E, respectively, into unbalanced signals and output the unbalanced signals to the bases of transistors 38, 39, 40 and 41, respectively. The unbalanced signals are subjected to wired OR by the transistors 38 to 41, inverted by an inverter 42 and then output from the port F. The signal lines connected to the ports D and E of the interface 23 are not shown in FIG. 1.

In FIG. 3, when an unbalanced signal is input to the port H, a balanced signal is output from the port J by a driver 43 in the same way as that in FIG. 2. When a balanced signal is input to the port K, an unbalanced signal is output from the port I by a differential amplifier 44.

The operation of this embodiment is described below with reference to FIGS. 1, 2 and 3. For example, the hall side is mainly described below.

The signal transmitted from the hall transmission control microcomputer 3 is output to the port G of the interface 23, converted into a balanced transmit signal by the driver 33 and then output from the port A. Since the balanced signal line 28 connects, in a bus arrangement, the port A of the interface 23 and the ports K of the interfaces 25 and 26, the transmit signal is input to the ports K of the interfaces 25, 26. The differential amplifier 44 of each of the interfaces 25, 26 converts the balanced transmit signal into an unbalanced signal and then transmits the unbalanced signal to each of the hall microcomputers 6 to 9 from the port I.

The signal transmitted from each of the hall microcomputers 6 to 9 is output to the unbalanced signal lines 15*a* and 15*b* and then input to the ports H of the interfaces 25, 26. The transmit signal is converted into a balanced transmit signal by the driver 43 and then output from the port J.

In order to permit the simultaneous transmission from the hall microcomputers 6 to 9, i.e., collision of output data, the unbalanced signal lines 15*a* and 15*b* are connected in a bus arrangement, and the balanced signal lines 29, 30 are connected in a star arrangement.

The signals transmitted from the hall microcomputers 6 to 9 and output from the ports J of the interfaces 25 and 26 are respectively input to the ports B, C of the interface 23 through the signal lines 29, 30, subjected to wired OR by the transistors 38, 39, output from the port F and then input to the hall transmission control microcomputer 3.

The transmission distance covered is 100 m by each of the unbalanced signal lines 14*a*, 15*a*, 14*b* and 15*b*. For instance, in the case of a building of 200 m high, after the balanced signal lines 28 and 30 are laid 100 m, the interface 26 is installed, and the unbalanced signal lines 14*b*, 15*b* are laid 100 m in a lower portion of the building. After the balanced signal lines 28 and 29 are laid over 100 several meters in an upper portion of the building, the interface 25 is installed, and the unbalanced signal lines 14*a*, 15*a* are laid.

Although the operation on the hall side is described above, when the same operation is applied to the car side, the same effects are of course obtained.

As described above, in the embodiment 1, a balanced transmission line and an unbalanced transmission line are connected to each other with an interface therebetween, and the hall microcomputers (child stations) are connected to the unbalanced transmission lines. In addition, in a balanced portion, the signal lines from the hall transmission control microcomputer (parent station) to the hall microcomputers are connected in a bus arrangement, and the signal lines from the hall microcomputers to the hall transmission control microcomputer are connected in a star arrangement. Namely, the balanced transmission line is used for increasing the distance of the unbalanced transmission line, and the: hall microcomputers are connected to the unbalanced transmission line. This embodiment thus exhibits the effect of realizing high-quality transmission having excellent noise resistance, as compared with the case where all transmission lines used are an unbalanced type. The embodiment also has the effects of decreasing the cost and of increasing the transmission efficiency, as compared with the case where all transmission lines used are a balanced type.

What is claimed is:

1. An elevator signal transmitting apparatus comprising:

a parent station provided in a control panel so as to control signal transmission;

a plurality of child stations respectively provided in halls so as to control signal transmission;

third interface means connected to said parent station for converting unbalanced signals input from said parent station into balanced signals to output the balanced signals through a first port and for converting balanced signals input through a second port into unbalanced signals to output the unbalanced signals to said parent station;

first and second balanced transmission lines each having one ends connected to the first and second ports of said third interface means, respectively;

first and second unbalanced transmission lines each having one end connected to one of said plurality of child stations;

first interface means connected between the other ends of said first balanced transmission line and of said first unbalanced transmission line for converting balanced signals input from said third interface means through said first balanced transmission line into unbalanced signals to output the unbalanced signals to the child station through said first unbalanced transmission line; and second interface means connected between the other ends of said second balanced transmission line and of said second unbalanced transmission line for converting unbalanced signals input from the child station through said second unbalanced transmission line into balanced signals to output the balanced signals to said third interface means through said second balanced transmission line.

2. A signal transmitting apparatus according to claim 1, wherein said plurality of child stations are divided into a plurality of groups each comprising hall child stations at adjacent floors, said first interface means contains a plurality of first interface circuits corresponding to said plurality of groups, and said second interface means contains a plurality of second interface circuits corresponding to said plurality of groups.

3. A signal transmitting apparatus according to claim 2, wherein said first balanced transmission line is connected in a bus arrangement to said first interface circuits, and said second balanced transmission line is connected in a star arrangement to said second interface circuits.

4. A signal transmitting apparatus according to claim 1, wherein said first interface means comprises a differential amplifier for converting a balanced signal into an unbalanced signal.

5. A signal transmitting apparatus according to claim 1, wherein said second interface means comprises a driver for converting an unbalanced signal into a balanced signal.

6. An elevator signal transmitting apparatus comprising:

a parent station provided in a machine room so as to control signal transmission;

a child station provided in a car so as to control signal transmission;

third interface means connected to said parent station for converting unbalanced signals input from said parent station into balanced signals to output the balanced signals through a first port and for converting balanced signals input through a second port into unbalanced signals to output the unbalanced signals to said parent station;

first and second balanced transmission lines each having one end connected to the first and second ports of said third interface means, respectively;

first and second unbalanced transmission lines each having one end connected to said child station;

first interface means connected between the other ends of said first balanced transmission line and of said first unbalanced transmission line so as to convert the balanced signal input from said third interface means through said first balanced transmission line into an unbalanced signal and output said unbalanced signal to said child station through said first unbalanced transmission line; and second interface means connected between the other ends of said second balanced transmission line and of said second unbalanced transmission line so as to convert the unbalanced signal input from said child station through said second unbalanced transmission line into a balanced signal and output said balanced signal to said third interface means through said second balanced transmission line.

7. A signal transmitting apparatus according to claim 6, wherein said first interface means comprises a differential amplifier for converting a balanced signal into an unbalanced signal.

8. A signal transmitting apparatus according to claim 6, wherein said second interface means comprises a driver for converting an unbalanced signal into a balanced signal.

9. The signal transmitting apparatus according to claim 1, wherein said third interface means comprises a first circuit for converting an unbalanced signal into a balanced signal, and a second circuit for converting a balanced signal into an unbalanced signal and for providing stable output, said first circuit including a driver, and said second circuit including a plurality of differential amplifiers, a plurality of transistors, and an inverter, each of said plurality of transistors including a base, an emitter and a collector, the bases of said plurality of transistors being connected to the plurality of differential amplifiers, the emitters being connected to ground, and the collectors being connected to said inverter.

10. The signal transmitting apparatus according to claim 6, wherein said third interface means comprises a first circuit for converting an unbalanced signal into a balanced signal, and a second circuit for converting a balanced signal into an unbalanced signal and for providing stable output, said first circuit including a driver, and said second circuit including a plurality of differential amplifiers, a plurality of transistors, and an inverter, each of said plurality of transistors including a base, an emitter and a collector, the bases of said plurality of transistors being connected to the plurality of differential amplifiers, the emitters being connected to ground, and the collectors being connected to said inverter.

* * * * *